US005408995A

United States Patent [19]

Contino et al.

[11] Patent Number: 5,408,995

[45] Date of Patent: Apr. 25, 1995

[54] CONTINUOUS FLOW PASSENGER OXYGEN DISPENSING UNIT

[75] Inventors: Joseph J. Contino, Buffalo; Jeffrey L. Landis, Getzville, both of N.Y.; George F. McKinnon, El Dorado Hills, Calif.

[73] Assignee: Figgie International Inc., Willoughby, Ohio

[21] Appl. No.: 48,783

[22] Filed: Apr. 16, 1993

[51] Int. Cl.[6] ..... A62B 18/02; A62B 9/02

[52] U.S. Cl. ..... 128/205.25; 128/205.17; 128/205.24; 128/205.13

[58] Field of Search ..... 128/205.13, 205.14, 128/205.15, 205.16, 205.17, 205.24, 205.25, 201.23, 205.22, 204.18, 206.21, 206.28, 207.12

[56] References Cited

U.S. PATENT DOCUMENTS

| | | | |
|---|---|---|---|
| 3,137,296 | 6/1964 | Gurtowski | 128/206.12 |
| 3,347,566 | 10/1967 | Nelson | 285/1 |
| 3,357,426 | 12/1967 | Cohen | 128/202.27 |
| 3,486,730 | 12/1969 | Potash | 251/129.7 |
| 4,098,271 | 7/1978 | Maddock | 128/202.22 |
| 4,111,197 | 9/1978 | Warncke et al. | 128/202.27 |
| 4,488,546 | 12/1984 | Bernhardt et al. | 128/201.23 |
| 4,559,939 | 12/1985 | Levine et al. | 128/201.28 |
| 4,766,893 | 8/1988 | Drews | 128/201.29 |
| 4,832,017 | 5/1989 | Schnoor | 128/206.12 |
| 4,865,027 | 9/1989 | Laanen et al. | 128/200.21 |
| 4,869,245 | 9/1989 | Nowakowski et al. | 128/201.23 |
| 5,002,050 | 3/1991 | McGinnis | 128/204.21 |
| 5,163,424 | 11/1992 | Kohnke | 128/205.13 |
| 5,265,597 | 11/1993 | Wallis | 128/205.25 |

*Primary Examiner*—Edgar S. Burr
*Assistant Examiner*—Eric P. Raciti
*Attorney, Agent, or Firm*—Jones, Day, Reavis & Pogue

[57] ABSTRACT

A continuous flow passenger oxygen dispensing unit of the type used on pressurized aircraft by passengers during decompression emergencies. The present invention includes an integrally reinforced reservoir bag with an easily connectable and detachable coupling member, further including an airflow channel designed to prevent sticking while being collapsed during storage.

8 Claims, 4 Drawing Sheets

CONTINUOUS FLOW PASSENGER OXYGEN DISPENSING UNIT

FIELD OF THE INVENTION

This invention relates to a continuous flow passenger oxygen dispensing unit of the type used on aircraft with pressurized cabins by passengers during decompression emergencies to provide supplemental oxygen. The present invention includes an integrally reinforced reservoir bag with an easily connectable and detachable coupling member, further including an airflow channel designed to prevent sticking while being collapsed during storage.

BACKGROUND OF THE INVENTION

Modern pressurized passenger aircraft fly at altitudes in the range of 18,000 to 40,000 feet. At these altitudes the air is at a reduced density because the atmospheric pressure is much lower than at sea level. Thus, the partial pressure of oxygen in the air is not sufficient to sustain normal respiration. Consequently, there has been a need for a system to supply additional oxygen for the survival of passengers in the event of a depressurization emergency of the airplane cabin.

In the prior art, especially in U.S. Pat. Nos. 4,098,271 and 4,832,017, there are shown emergency oxygen breathing apparatuses which each include a facepiece having valves, the facepiece designed to cover the nose and mouth and also is connected to an oxygen delivery tube. Connected between the facepiece and the delivery tube is a bag which functions as a reservoir, permitting an efficient use of the limited oxygen supply. In order to activate the flow of oxygen, the facepiece and bag assembly must be pulled down by the passenger; current specifications require that the assembly be capable of withstanding a static tensile force of not less than 20 pounds for at least three seconds. In accordance with FAA requirements, these bags are made of a lightweight and resilient vinyl plastic material. However, such prior art bags in their current design cannot themselves withstand the 20 pound static tensile force without failure. The solution found in prior art systems is to insert within the bags a strain relief mechanism, typically a taut string, to withstand the tensile force.

FIG. 1 shows such a prior art system. This prior art (indicated generally at 10) includes a facepiece 11, bag 12, and a delivery tube 13. The assembly is provided with a string 14, connected from the facepiece directly to the delivery tube in which the string functions as a strain relief mechanism. This strain relief mechanism is designed to withstand the 20 pound static tensile force that would otherwise be applied to the bag. However, such prior art devices are difficult to manufacture and include extra materials and process steps resulting in additional time needed for the manufacture of the device, thus contributing to the expense. The prior art connectors joining the bag and facepiece are difficult to assemble and could not easily be assembled by maintenance personnel in the field. Further, the prior art connectors cannot withstand the 20 pound static tensile force without a strain relief mechanism. As a result, it would be desirable to eliminate the string 14 from the assembly.

One solution would be to select stronger materials which would produce an inherently stronger bag. However, other materials that could be used may be more flammable or entail increased weight and, therefore, cost. Consequently, such materials would need to undergo the long and costly process of being "requalified" in order to conform to FAA requirements. Therefore, it is not practical to use stronger bag materials as a substitute for the strain relief mechanism. Additionally, the prior art joint between the bag and the facepiece is not sufficient to withstand the required load.

SUMMARY OF THE INVENTION

In the prior art systems, the delivery tube and facepiece connector have the strain relief mechanism attached to them and include additional securement which makes it difficult to easily replace a worn out bag. Consequently, the entire assembly is usually thrown away after a period of use, including facepieces which are still viable. It is an object of the present invention to provide a "quick connect" bag and facepiece that permits easy replacement of an old bag while retaining the facepiece, thus facilitating field changes of the bag resulting in reduced replacement expense and therefore greater efficiency for the airlines.

In accordance with the present invention, there is a need to eliminate the strain relief mechanism while still providing resistance to the static tensile 20 pound force. It is therefore a further object of the present invention to provide a bag which can withstand the static tensile 20 pound force using qualified materials, but requiring fewer parts and manufacturing steps, resulting in a savings of time and money.

The prior art assembly has the strain relief mechanism attached directly between the facepiece and the delivery tube so that there is no requirement for the joint between the bag and facepiece to withstand the static tensile 20 pound force. It is still a further object of the present invention to provide a coupling between the bag and facepiece that is capable of withstanding the 20 pound static tensile force while providing a fluid seal.

In continuous flow passenger oxygen dispensing units, there was a risk that the reservoir bag may stick together during storage and restrict the outlet, thus blocking the oxygen flow during use. In the prior art, the strain relief mechanism assisted in preventing such blockage. Therefore, it is still another object of the present invention to provide a bag outlet that minimizes the potential for the neck of the bag to stick together without the use of the strain relief mechanism.

The present invention relates to a continuous flow passenger oxygen dispensing unit which incorporates the above objects and includes a facepiece, a reservoir bag and a delivery tube. The reservoir bag is patterned with a reinforcing design in order to distribute the static tensile 20 pound force across the width of the bag. The present connector assembly is also configured to withstand this force. The present connector is formed from a protrusion on the bag outlet which fits inside an aperture in the valve plate of the facepiece. This connection is sufficient to provide for quick and easy assembly to facilitate field changes. The present connector is integral with the reservoir bag outlet which is formed with serrations on its inner wall which assist in permitting oxygen passage in the event the walls of the outlet stick together during stowage.

DETAILED DESCRIPTION OF THE DRAWINGS

Figure 2:
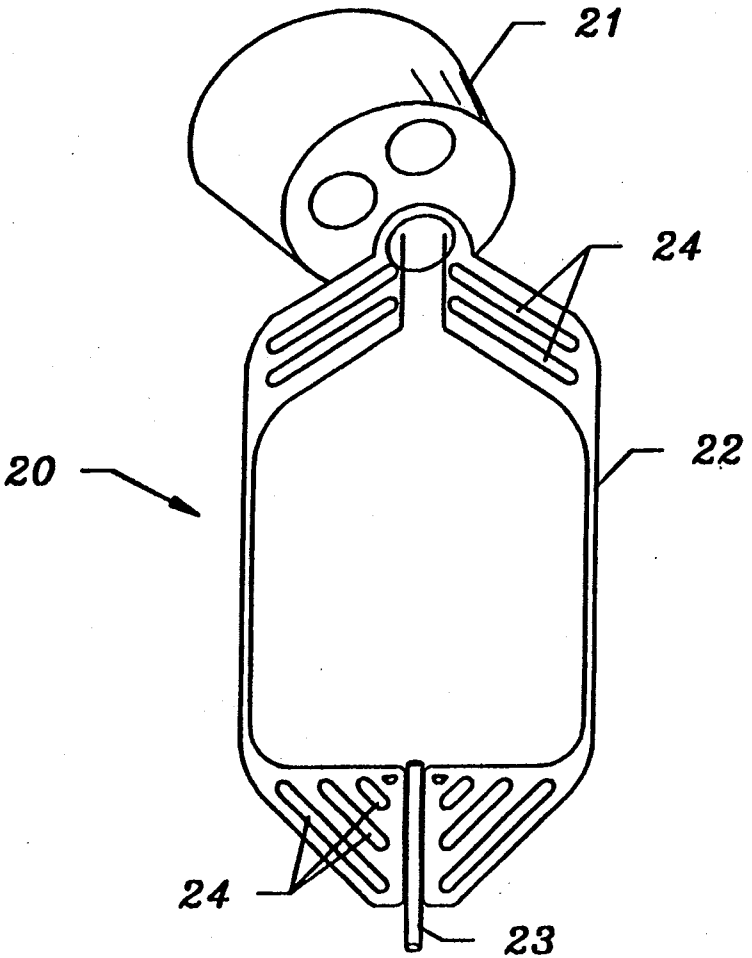
FIG. 2 depicts the configuration of the present continuous flow passenger oxygen dispensing unit.
Figure 1:
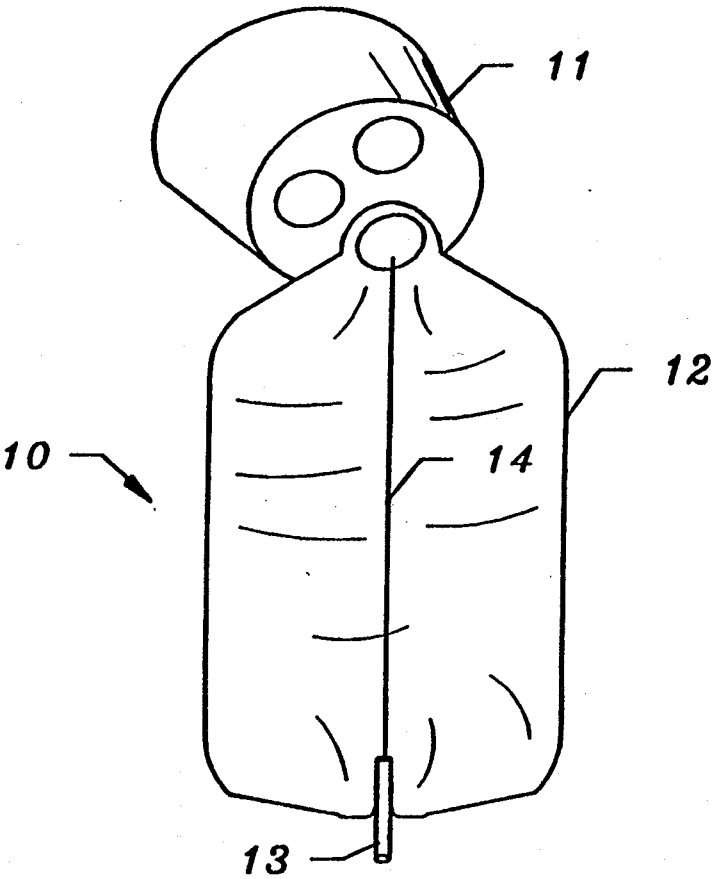
FIG. 1 PRIOR ART
FIG. 1 depicts the configuration of the prior art continuous flow passenger oxygen dispensing unit.
Figure 3:
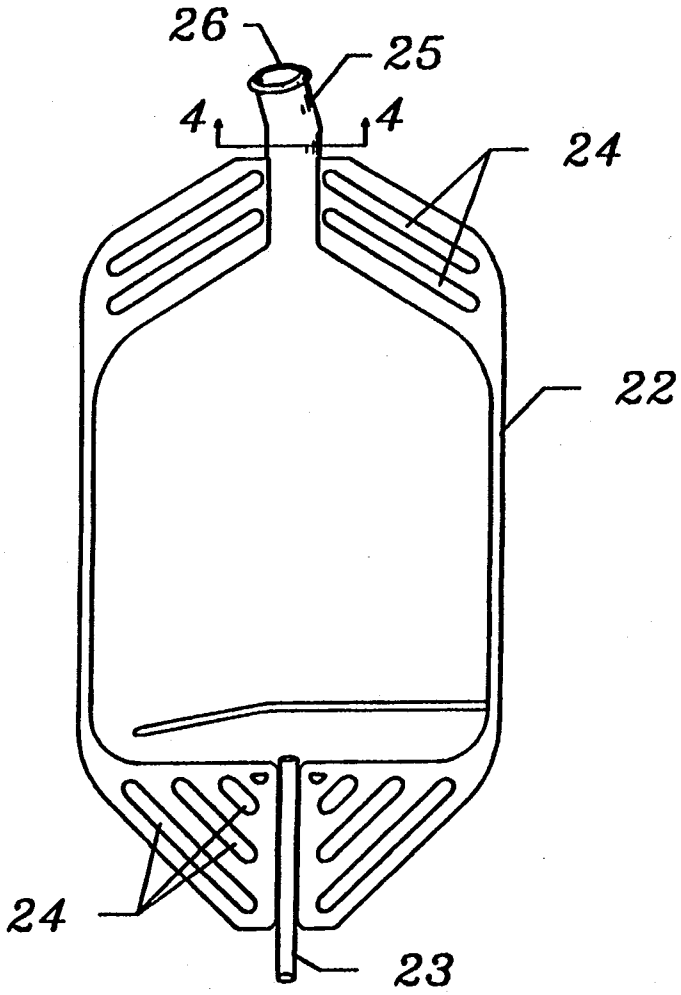
FIG. 3 shows a front plan view of the preferred form of the reservoir bag contemplated by the present invention.

In the present invention, shown generally at 20 in FIG. 2, the facepiece 21 is connected to reservoir bag 22, which in turn is connected to a delivery tube 23. As shown in FIGS. 2 and 3, the bag is manufactured with a strengthening pattern formed by directly fusing the vinyl film using the techniques of RF (radio frequency) welding, which are known in the art, for example, to weld seams. The pattern must be sufficient to distribute the static tensile 20 pound force over the width of the bag, thus eliminating the need for a discrete strain relief mechanism. The pattern is designed to distribute the vertically-applied force in a horizontal direction along the bag, to the left and right. The specific design of the pattern is not critical, but it must incorporate certain factors: force is distributed by the welds 24 and these must be of a sufficient width with sufficient distances between each weld; also, slanting the welds 24 at an angle (as show in FIGS. 2 and 3) helps distribute the force. Most importantly, however, are the welds where the delivery tube 23 joins the bag 22 and also where the outlet 25 joins the bag 22. These welds bear a significant portion of the force. As a means of securement, the delivery tube 23 is also attached to the bag 22 using RF welds. As an additional benefit of the present invention, the prior art vinyl film may still be used, and new materials, which would require requalification, are not needed.

As shown in FIGS. 2, 3, 4 and 5, the bag includes a cylindrical outlet 25 which is connected to the facepiece 21, with the outlet 25 including a serrated inner surface 27. The serrated surface 27 minimizes any sticking and also provides flow channels if the bag outlet 25 is collapsed and the walls stick together when stowed in an aircraft compartment for a period of up to three years. In the event of outlet collapse, the area of contact between opposing sidewalls will be minimal. The design may also include inverted U-shaped scallops (not shown) which are found at the base of the outlet 25 and permit oxygen flow to the sides of the scallops in the event of outlet collapse. As a result, this design permits the oxygen to flow in the event of activation during a decompression emergency.

Figure 4:
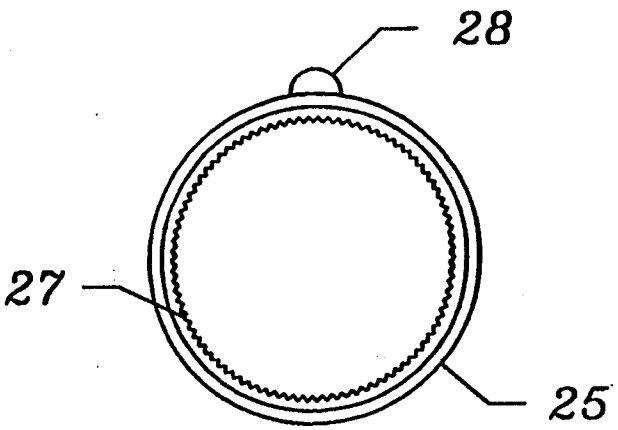
FIG. 4 shows a cross-section of the bag outlet along line 4—4 of FIG. 3.
Figure 6:
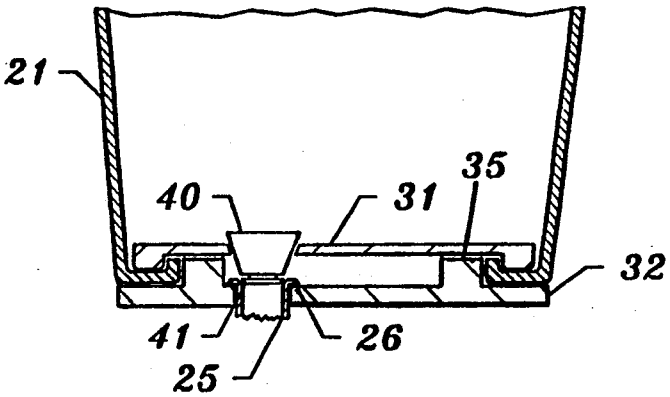
FIG. 6 details an assembled cross-sectional view of the facepiece and coupling mechanism of the present invention.
Figure 5:
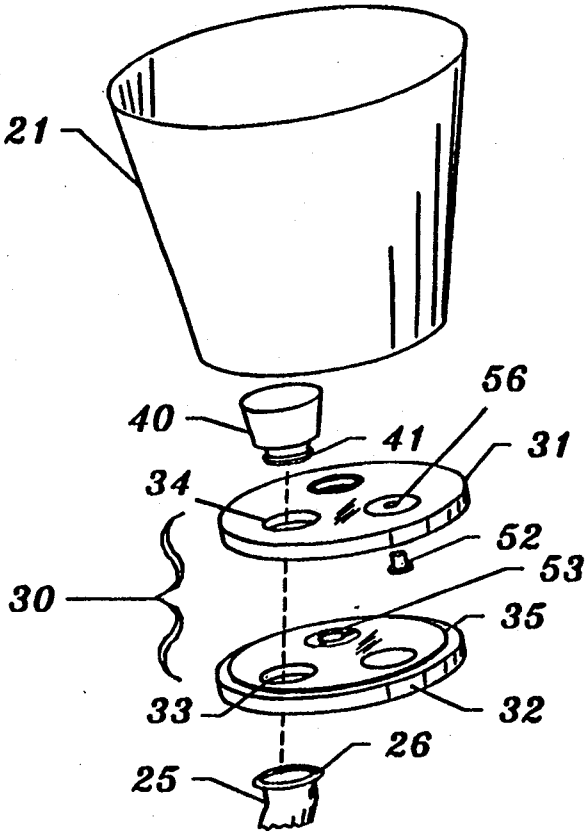
FIG. 5 shows an exploded view of the present facepiece and coupling mechanism.
Figure 7:
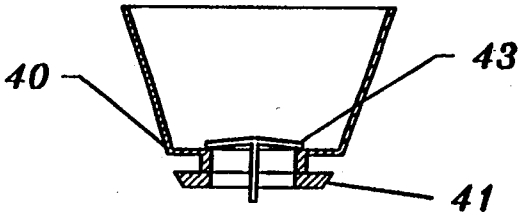
FIG. 7 details a cross-section of the retainer assembly, including flapper valve.
Figure 8:
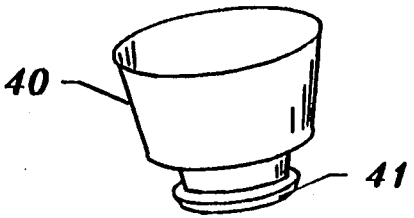
FIG. 8 shows the retainer in a perspective view.

FIGS. 5 and 6 detail the coupling between the facepiece 21 and the bag outlet 25. The facepiece 21 is attached to a valve plate assembly shown generally at 30 comprising an inner plate 31 and a outer plate 32, separated by a projection 35 and fused together using the known techniques of ultrasonic welding. The bag outlet 25 includes a protrusion 26 which fits inside a hole 33 of the outer plate 32. The hole 33 has a diameter or dimension (in the case of a non-circular opening) which is less than the outer extent of the protrusion 26, providing a secure fit upon attachment. In the preferred embodiment, the protrusion is a circumferential flange, spanning the full 360 degrees of the circumference of the bag outlet 25. However, the protrusion may comprise one or more tabs, each with arc segments of less than a total of 360 degrees. As seen in FIG. 4, the outer edge of the protrusion may also include a protuberance 28 which serves as a "key way" to insure proper alignment of the bag with the facepiece. Inner plate 31 includes a hole 34 configured so as to be concentric with the outer plate hole 33. The facepiece valve plate assembly 30 accommodates an inhalation valve retainer 40 which fits inside the hole 34. The retainer 40 includes a radial barb fitting 41 which, in the preferred embodiment, extends circumferentially around the lower end of the retainer. This radial barb fitting 41 fits inside the inner diameter of bag outlet 25, and produces an interference fit and creates a fluid seal between the bag and the outer plate. The radial barb fitting 41 may also alternatively comprise one or more tabs, each with arc segments of less than a total of 360 degrees. The inhalation valve retainer 40, shown in cross-section in FIG. 7, is designed to seat and retain an inhalation flapper valve 43. The flapper valve 43 permits the flow of oxygen from the reservoir bag 22 only during inhalation from the passenger and prevents exhalation into the bag, thus permitting maximum conservation of oxygen while ensuring passenger safety.

Figure 9:
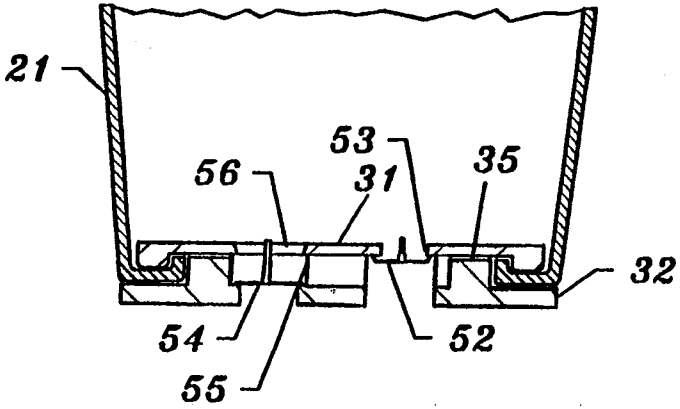
FIG. 9 shows are assembled cross-sectional view of the facepiece along a line to detail the ambient inhalation and exhaust valves.

As shown in FIG. 9, the facepiece valve plate assembly 30 includes apertures which are adapted to retain an ambient inhalation valve 54 and an exhalation valve 52, both of which are typical in the prior art design. During use, the passenger inhales a mixture of rarified ambient air and supplemental oxygen, which pass through each of their respective valves. The passenger then exhales through the exhalation valve.

The connector assembly, comprising the facepiece valve plate assembly 30, the bag outlet protrusion 26, and the radial barb fitting 41 of the retainer 40, are designed to provide a quick connecting and detachable securement for the assembly. The interference fit of this securement is sufficient so as to permit the connection to provide a fluid seal and withstand the required 20 pound static tensile force applied during activation of oxygen flow by the passenger. However, this coupling does not require any complicated attachment configurations as are found in the prior art. This connection may be easily disengaged by maintenance personnel at appropriate intervals. In the present invention, the device may be more easily disassembled into its components. These components, such as the bag assembly 22 which has a relatively short useful life, may be easily detached from the components with a longer useful life, such as the facepiece 21. The present coupling may permit a longer useful life for the various components of the system than had been capable previously in the prior art.

The foregoing description is that of the preferred embodiment of the invention. Various changes and modifications may be made by persons of ordinary skill in the art without departing from spirit and scope of the invention as defined in the appended claims.

What is claimed is:

1. A continuous flow passenger oxygen dispensing unit for providing supplemental oxygen in the event of loss of cabin pressure in a pressurized aircraft, said assembly comprising:

a facepiece for introducing oxygen to the nose and mouth of a passenger;

a bag attached to said facepiece and having a delivery tube attached to said bag and adapted to be connected to an oxygen supply system, said bag having an enclosed volume to act as a reservoir for oxygen for breathing by a passenger;

said bag having an outlet extending therefrom for delivery of oxygen into said facepiece and a protrusion formed integrally on said outlet of said bag which is received through an aperture in said facepiece having a diameter less than the outer extent of said protrusion; and a retainer in the form of a separate discrete element received within said outlet in said bag to hold said protrusion of said bag outlet in an easily assembled connection between said facepiece and said bag, said connection between said bag and facepiece also adapted to provide a fluid seal and withstand at least a static tensile 20 pound force.

2. A continuous flow passenger oxygen dispensing unit as claimed in claim 1 wherein said bag is formed of a lightweight vinyl film with a reinforcing pattern composed of fused portions of the walls of the bag for distributing a static tensile 20 pound force across the width of said bag.

3. A continuous flow passenger oxygen dispensing unit as claimed in claim 2 wherein said pattern is formed in said bag using RF welding.

4. A continuous flow passenger oxygen dispensing unit as claimed in claim 1 wherein said facepiece comprises a valve plate assembly further comprising an inner plate and an outer plate which are secured to each other and to side walls of the facepiece to form the facepiece's bottom.

5. A continuous flow passenger oxygen dispensing unit as claimed in claim 4 wherein said aperture which receives said bag is in said valve plate assembly.

6. A continuous flow passenger oxygen dispensing unit as claimed in claim 1 wherein said retainer further comprises a flapper valve assembly.

7. A continuous flow passenger oxygen dispensing unit as claimed in claim 1 wherein said retainer includes a radial barb fitting which extends circumferentially around an edge of said retainer in order to produce an interference fit and fluid seal between said bag opening and said retainer.

8. A continuous flow passenger oxygen dispensing unit as claimed in claim 1 wherein said outlet of said bag comprises a cylindrical outlet with a serrated inner surface for preventing the collapse and inadvertent sealing of said outlet during storage.

* * * * *